US009107516B2

(12) United States Patent
Pichel

(10) Patent No.: US 9,107,516 B2
(45) Date of Patent: Aug. 18, 2015

(54) MERCHANDISING SYSTEM WITH PUSHER ASSEMBLY

(71) Applicant: DISPLAY TECHNOLOGIES, College Point, NY (US)

(72) Inventor: Matthew Pichel, Englewood, NJ (US)

(73) Assignee: Display Technologies, LLC, Lake Success, NY (US)

( * ) Notice: Subject to any disclaimer, the term of this patent is extended or adjusted under 35 U.S.C. 154(b) by 0 days.

(21) Appl. No.: 13/915,134

(22) Filed: Jun. 11, 2013

(65) Prior Publication Data

US 2014/0360953 A1 Dec. 11, 2014

(51) Int. Cl.
*A47F 1/04* (2006.01)
*A47F 1/12* (2006.01)

(52) U.S. Cl.
CPC .. *A47F 1/04* (2013.01); *A47F 1/126* (2013.01)

(58) Field of Classification Search
CPC ..... A47F 1/04; A47F 1/12; A47F 1/125; A47F 1/126
USPC ..... 211/49.1, 59.2, 59.3, 59.4; 221/226, 221/279, 124
See application file for complete search history.

(56) References Cited

U.S. PATENT DOCUMENTS 4,830,201 A * 5/1989 Breslow ..... 211/184
4,899,893 A 2/1990 Robertson
4,958,739 A * 9/1990 Spamer ..... 211/153
4,997,094 A * 3/1991 Spamer et al. ..... 211/153
5,024,336 A * 6/1991 Spamer ..... 211/59.2
5,190,186 A * 3/1993 Yablans et al. ..... 221/124
5,562,217 A * 10/1996 Salveson et al. ..... 211/59.3
5,634,564 A * 6/1997 Spamer et al. ..... 211/59.3
5,685,664 A * 11/1997 Parham et al. ..... 403/393
5,855,281 A * 1/1999 Rabas ..... 211/59.3
6,129,218 A * 10/2000 Henry et al. ..... 211/59.3
6,142,316 A * 11/2000 Harbour et al. ..... 211/59.2
6,142,317 A 11/2000 Merl
6,227,385 B1 * 5/2001 Nickerson ..... 211/59.3
6,325,221 B2 * 12/2001 Parham ..... 211/59.2
6,357,606 B1 * 3/2002 Henry ..... 211/59.3

(Continued)

FOREIGN PATENT DOCUMENTS

EP 478570 B1 * 12/1995
EP 1208773 A1 * 5/2002

(Continued)

OTHER PUBLICATIONS

International Search Report PCT/US14/40656.

*Primary Examiner* — Stanton L Krycinski
(74) *Attorney, Agent, or Firm* — Carter, DeLuca, Farrell & Schmidt, LLP

(57) ABSTRACT

A merchandising system for a displaying a plurality of products is disclosed. The system comprises a base and a pusher member. The base includes a product-supporting surface and a track disposed beneath the product-supporting surface. Thee base defines a longitudinal axis. The pusher member is disposed in mechanical cooperation with the base and is configured to slide longitudinally with respect to the base. The pusher member includes a base-contacting surface and a plurality of legs downwardly depending from the base-contacting surface. Each of the plurality of legs is configured to mechanically engage the track. The track includes a discontinuity to enable the legs of the pusher member to selectively mechanically engage the track.

14 Claims, 13 Drawing Sheets

(56) References Cited

U.S. PATENT DOCUMENTS

| | | | | |
|---|---|---|---|---|
| 6,409,027 | B1 * | 6/2002 | Chang et al. | 211/59.3 |
| 6,464,089 | B1 * | 10/2002 | Rankin, VI | 211/59.3 |
| 6,523,702 | B1 * | 2/2003 | Primiano et al. | 211/59.2 |
| 6,615,995 | B2 * | 9/2003 | Primiano et al. | 211/59.2 |
| 6,622,874 | B1 * | 9/2003 | Hawkinson | 211/59.3 |
| 6,695,152 | B1 * | 2/2004 | Fabrizio et al. | 211/59.2 |
| 6,715,621 | B2 * | 4/2004 | Boron | 211/59.2 |
| 6,769,552 | B1 * | 8/2004 | Thalenfeld | 211/59.3 |
| 6,772,888 | B2 * | 8/2004 | Burke | 211/59.3 |
| 6,779,670 | B2 * | 8/2004 | Primiano et al. | 211/74 |
| 6,886,699 | B2 * | 5/2005 | Johnson et al. | 211/59.3 |
| 6,889,854 | B2 * | 5/2005 | Burke | 211/59.3 |
| 6,923,330 | B1 * | 8/2005 | Nagel | 211/59.3 |
| 6,962,260 | B2 * | 11/2005 | Jay et al. | 211/59.2 |
| 6,964,235 | B2 * | 11/2005 | Hardy | 108/61 |
| 7,083,054 | B2 * | 8/2006 | Squitieri | 211/59.2 |
| 7,093,546 | B2 * | 8/2006 | Hardy | 108/60 |
| 7,168,579 | B2 | 1/2007 | Richter et al. | |
| 7,182,209 | B2 * | 2/2007 | Squitieri | 211/59.2 |
| 7,681,744 | B2 | 3/2010 | Johnson | |
| D613,101 | S | 4/2010 | Hardy | |
| D613,102 | S | 4/2010 | Hardy | |
| 7,784,623 | B2 * | 8/2010 | Mueller et al. | 211/59.3 |
| 7,823,734 | B2 | 11/2010 | Hardy | |
| D630,458 | S | 1/2011 | Hardy | |
| 7,891,503 | B2 * | 2/2011 | Hardy | 211/59.3 |
| 7,931,156 | B2 * | 4/2011 | Hardy | 211/59.3 |
| 8,066,128 | B2 * | 11/2011 | Crawbuck et al. | 211/59.3 |
| 8,096,427 | B2 * | 1/2012 | Hardy | 211/59.3 |
| 8,127,944 | B2 | 3/2012 | Hardy | |
| 8,312,999 | B2 | 11/2012 | Hardy | |
| 8,322,544 | B2 | 12/2012 | Hardy | |
| 8,360,253 | B2 | 1/2013 | Hardy | |
| 8,561,817 | B1 * | 10/2013 | Allen | 211/59.3 |
| 8,662,319 | B2 * | 3/2014 | Hardy | 211/59.3 |
| 2001/0010302 | A1 * | 8/2001 | Nickerson | 211/59.3 |
| 2002/0088762 | A1 * | 7/2002 | Burke | 211/59.3 |
| 2002/0108916 | A1 * | 8/2002 | Nickerson | 211/59.3 |
| 2002/0179553 | A1 * | 12/2002 | Squitieri | 211/59.2 |
| 2003/0010732 | A1 * | 1/2003 | Burke | 211/59.3 |
| 2003/0080075 | A1 * | 5/2003 | Primiano et al. | 211/59.2 |
| 2003/0085187 | A1 * | 5/2003 | Johnson et al. | 211/59.3 |
| 2004/0004046 | A1 * | 1/2004 | Primiano et al. | 211/59.2 |
| 2004/0020877 | A1 * | 2/2004 | Boron | 211/59.2 |
| 2004/0118794 | A1 * | 6/2004 | Hardy | 211/59.3 |
| 2005/0092703 | A1 * | 5/2005 | Mueller et al. | 211/59.3 |
| 2005/0286700 | A1 * | 12/2005 | Hardy | 379/202.01 |
| 2007/0068885 | A1 * | 3/2007 | Busto et al. | 211/59.3 |
| 2007/0175840 | A1 | 8/2007 | Richter | |
| 2008/0156752 | A1 * | 7/2008 | Bryson et al. | 211/59.3 |
| 2009/0184069 | A1 | 7/2009 | Hardy | |
| 2011/0094980 | A1 * | 4/2011 | Cousin et al. | 211/59.2 |
| 2011/0139736 | A1 * | 6/2011 | Hardy | 211/59.3 |
| 2011/0215060 | A1 * | 9/2011 | Niederhuefner | 211/59.3 |

FOREIGN PATENT DOCUMENTS

| | | | |
|---|---|---|---|
| EP | 1312285 | A1 * | 5/2003 |
| GB | 2360514 | A * | 9/2001 |

* cited by examiner

MERCHANDISING SYSTEM WITH PUSHER ASSEMBLY

BACKGROUND

The present disclosure relates generally to displaying products on a shelf. More particularly, the present disclosure relates to storing and/or displaying products to provide for the space-efficient presentation of groups of products within a given or fixed display area, and/or allowing for convenient and orderly presentation, dispensing, stocking, and storage of products.

Various types of product merchandisers are commonly used in retail environments to display different types of products. As opposed to simply positioning products on shelves, product displays are commonly used to position products on a shelf in manner which automatically advances (e.g., via gravity or a pusher) a trailing or distal product (i.e., a product that is behind a lead or proximal-most product) closer to a user once the lead product has been removed from the shelf. As can be appreciated, such product displays facilitate the arrangement and upkeep of products, as the trailing products don't have to be manually moved towards the front of the shelf, for instance.

SUMMARY

The present disclosure relates to a merchandising system for a displaying a plurality of products. The system comprises a base and a pusher member. The base includes a product-supporting surface and a track disposed beneath the product-supporting surface. Thee base defines a longitudinal axis. The pusher member is disposed in mechanical cooperation with the base and is configured to slide longitudinally with respect to the base. The pusher member includes a base-contacting surface and a plurality of legs downwardly depending from the base-contacting surface. Each of the plurality of legs is configured to mechanically engage the track.

The track includes a discontinuity to enable the legs of the pusher member to selectively mechanically engage the track.

In disclosed embodiments, the discontinuity in the track is between a proximal-most end of the track and a distal-most end of the track. Here, it is disclosed that the track extends proximally of the discontinuity and the track extends distally of the discontinuity.

In disclosed embodiments, the track includes a plurality of spaced-apart tabs.

In disclosed embodiments, the plurality of legs includes a first leg disposed on a first lateral side of the pusher member and a second leg disposed on a second lateral side of the pusher member. Here, it is disclosed that each of the first leg and the second leg includes a vertical portion disposed in contact with the base-contacting surface of the pusher member and a horizontal portion that extends from the vertical portion toward the second leg. The horizontal portion of the second leg extends from the vertical portion toward the first leg. Here, it is disclosed that each of the first leg and the second leg includes a substantially L-shaped cross-section In disclosed embodiments, at least one of the plurality of legs includes a substantially L-shaped cross-section.

In disclosed embodiments, the base includes a lower surface and a gap. The gap is defined between the lower surface and the product-supporting surface. Here, it is disclosed that the track is disposed at least partially within the gap. It is further disclosed that the track is entirely disposed within the gap. Here, it is disclosed that the track includes a plurality of spaced-apart tabs. It is further disclosed that a plurality of the spaced-apart tabs define a first distance between adjacent tabs, the discontinuity includes a space between adjacent tabs defining a second distance, and the second distance is greater than the first distance.

In disclosed embodiments, a distal section of the base is configured to be removed to effectively shorten the length of the merchandising system. Here, it is disclosed that the system further comprises a distal portion disposed distally of the distal section of the base. The distal portion is selectively removable from the distal section of the base, and the distal portion is re-installable with another section of the base after the distal section of the base has been removed. It is further disclosed that the distal portion includes a portion of the track. Here, it is disclosed that the pusher member is configured to slide along the entirety of the track both before the distal portion has been removed, and following removal of the distal section of the base and the re-installation of the distal portion. It is further disclosed that the distal portion includes a proximally-extending finger configured to mechanically engage a cut-out of the base.

In disclosed embodiments, a plurality of distal sections of the base are configured to be individually removed to effectively shorten the length of the merchandising system. Here, the merchandising system further comprises a distal portion disposed distally of the distal section of the base. The distal portion is selectively removable from a distal-most section of the base, and the distal portion is re-installable with another section of the base after any number of the plurality of distal sections of the base have been removed.

In disclosed embodiments, the system further comprises a proximal member disposed adjacent a proximal end of the base, and a biasing member mechanically coupled to both the pusher member and the proximal member. The biasing member is configured to proximally bias the pusher member.

BRIEF DESCRIPTION OF DRAWINGS

Embodiments of the present disclosure are described hereinbelow with reference to the drawings wherein.

DESCRIPTION

Embodiments of the presently disclosed merchandising system are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

Figure 1:
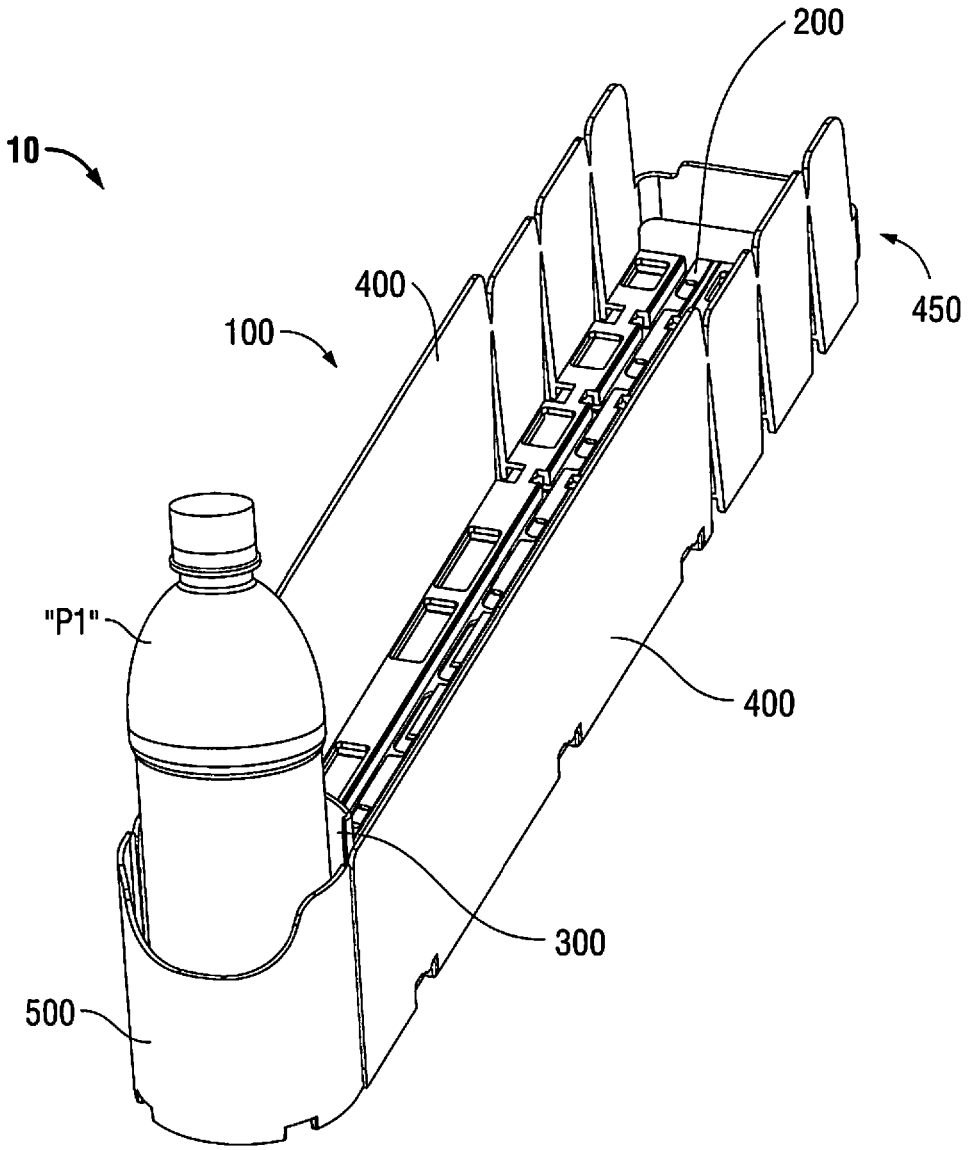
FIG. 1 is a perspective view of a merchandising system including one guide assembly for displaying items on a shelf according to embodiments of the present disclosure, and illustrated including one bottle thereon.
Figure 2A:
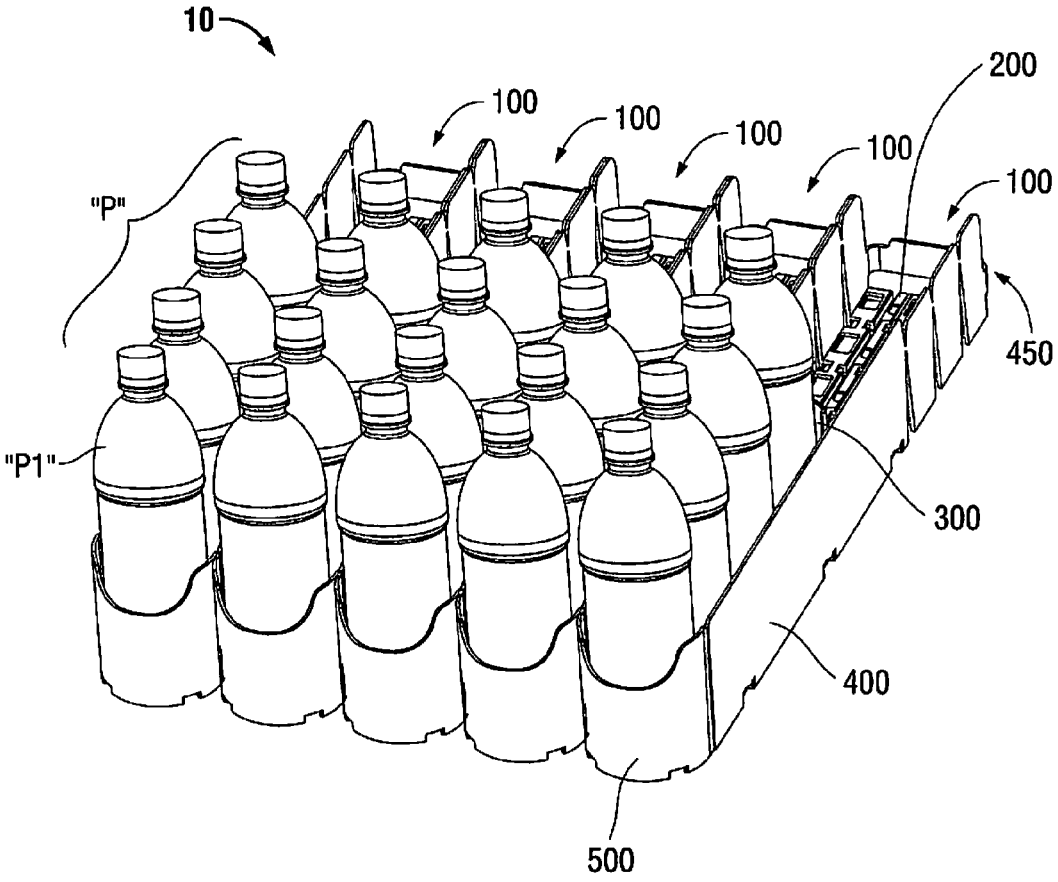
FIG. 2A is a perspective view of the merchandising system of FIG. 1 including five guide assemblies with a plurality of bottles thereon.
Figure 2B:
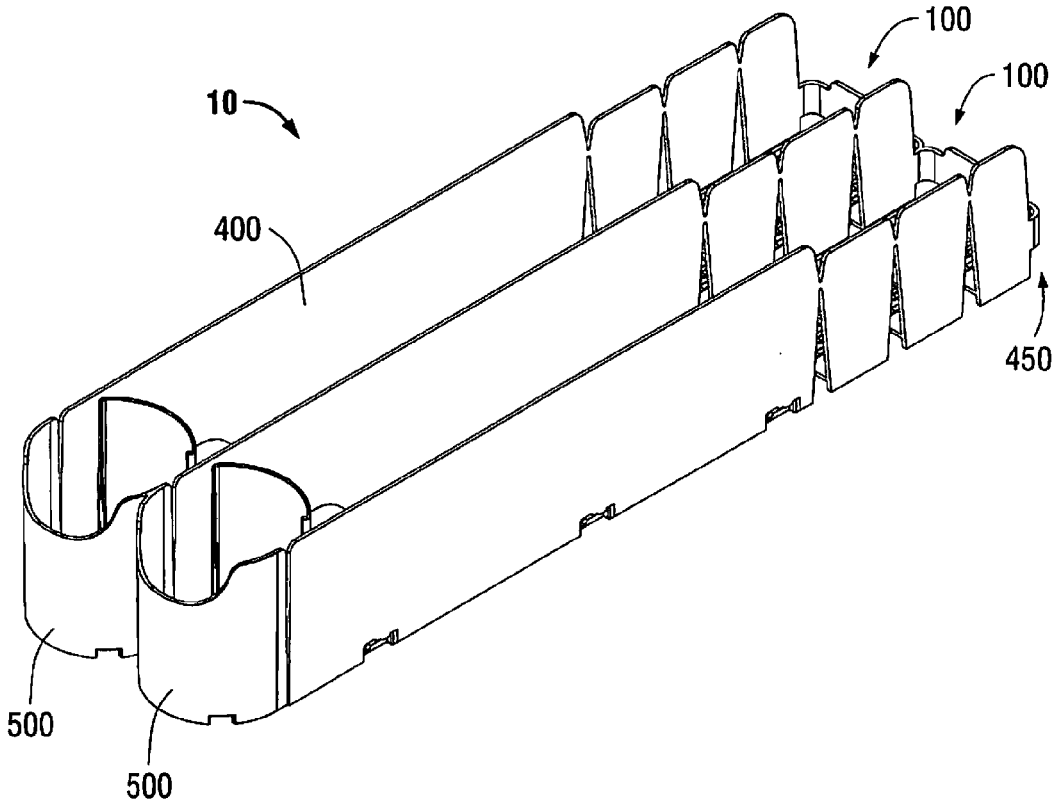
FIG. 2B is a perspective view of the merchandising system of FIGS. 1 and 2 including two guide assemblies with no bottles thereon.
Figure 3:
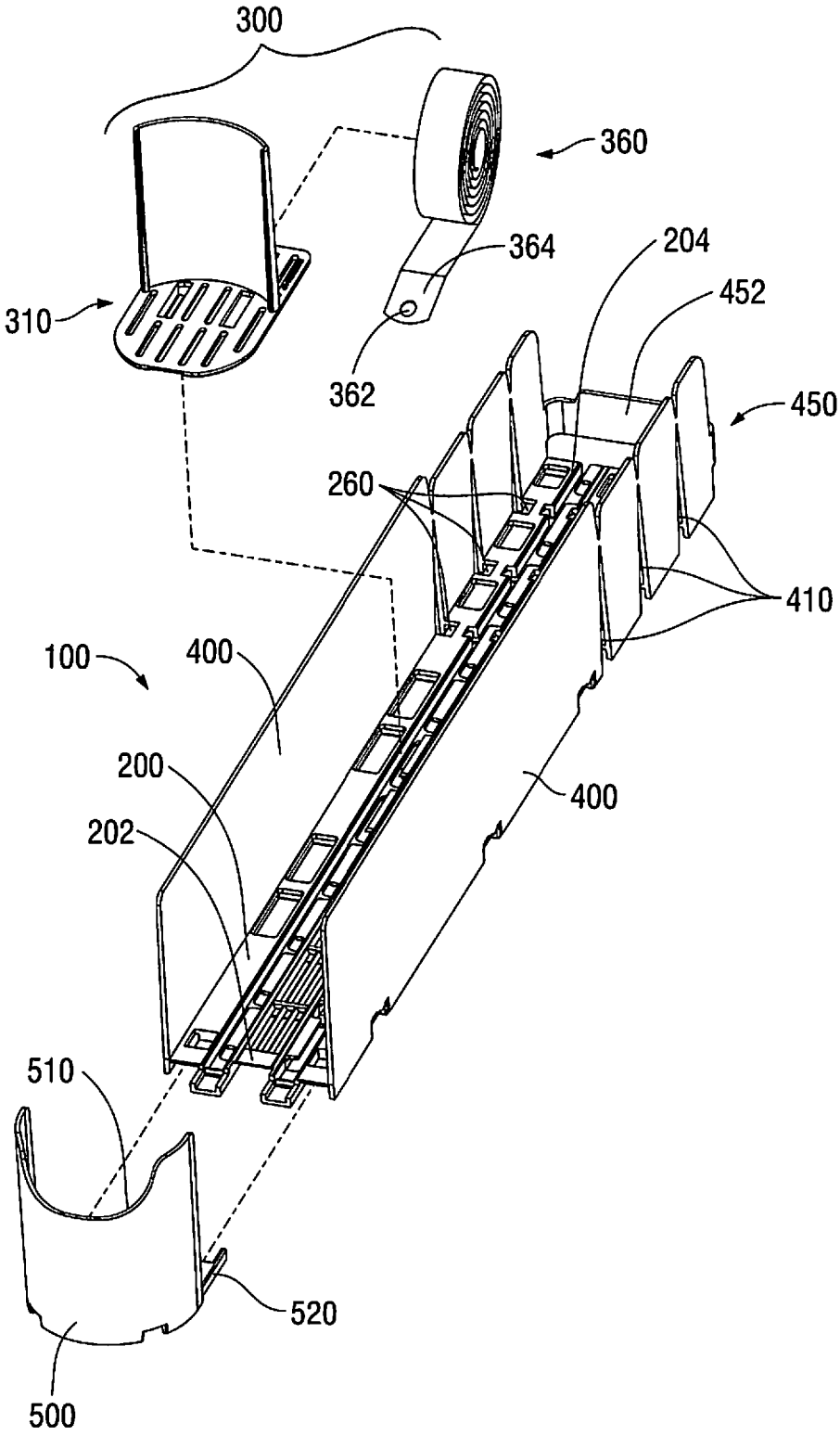
FIG. 3 is a perspective, assembly view of one guide assembly of the merchandising system.

Generally, with particular reference to FIGS. 1-3, a merchandising system 10 is disclosed that includes a plurality of guide assemblies 100. Each guide assembly 100 includes a base 200, a pusher assembly 300, a pair of lateral guides 400, a distal section 450, and a proximal member 500. The base 200, which is designed to be placed on a horizontal or included store shelf, is configured to support a plurality of products "P" thereon. The pusher assembly 300 is configured to urge product(s) "P" on the base 200 toward the proximal member 500. The lateral guides 400 are disposed in mechanical cooperation with base 200 (e.g., are integrally formed therewith, connectable thereto, etc.) and help maintain the products "P" on the base 200. A distal rail 452 of the distal section 450 and the proximal member 500 are also configured to help maintain the products "P" on the base 200.

One merchandising system 10 includes a plurality guide assemblies 100. In the embodiment illustrated in FIG. 2A, merchandising system 10 includes five guide assemblies 100, which, as shown, includes six lateral guides 400. In disclosed embodiments, merchandising system 10 includes more or fewer than five guide assemblies 100 and that the number of lateral guides 400 equals one more than the number of guide assemblies 100. As can be appreciated, several merchandising systems 10 are able to be positioned adjacent one another on a shelf.

With reference to FIGS. 4-9, the base 200 includes a product-supporting surface 210, a lower surface 220, a gap 230, a plurality of longitudinally extending ribs 240, and a track 250. The product-supporting surface 210 is the portion of the base on which products "P" are positioned. The lower surface 220 is the underside of the base 200. The gap 230 is the space between the product-supporting surface 210 and the lower surface 220. The ribs 240 extend along at least a portion of the base 200 between a proximal end 202 of the base 200 and a distal end 204 of the base 200 (see FIG. 3), and are configured to provide stability to base 200 and to reduce friction when a product "P" slides along the product-supporting surface 210, for example. The track 250 includes a plurality of spaced-apart tabs 252 that are positioned within the gap 230. The track 250 is configured to guide legs 340 of the pusher assembly 300 (as discussed in further detail below).

Figure 4:
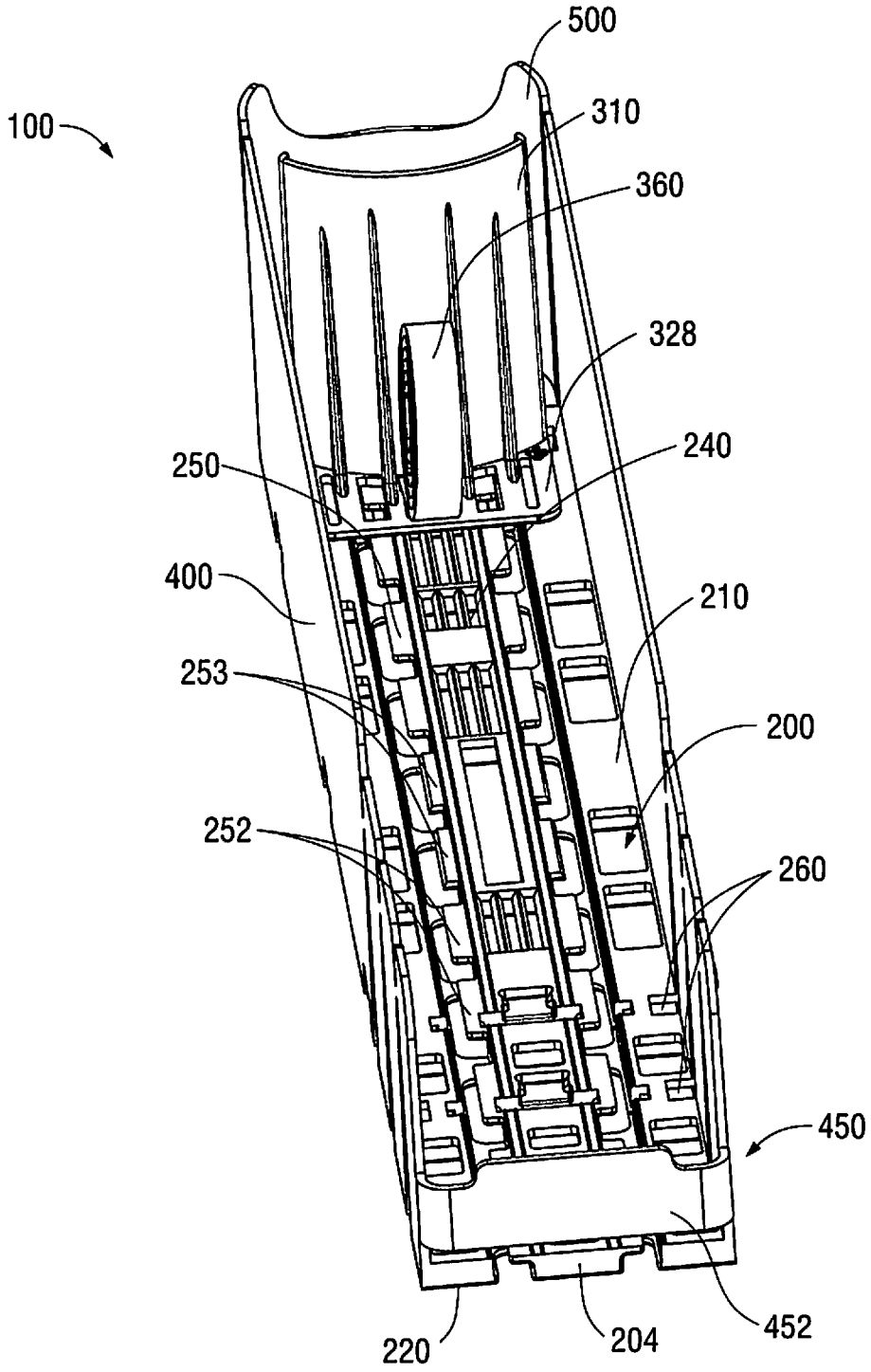
FIG. 4 is a perspective view, viewed from the rear, of one guide assembly of the merchandising system.
Figure 5:
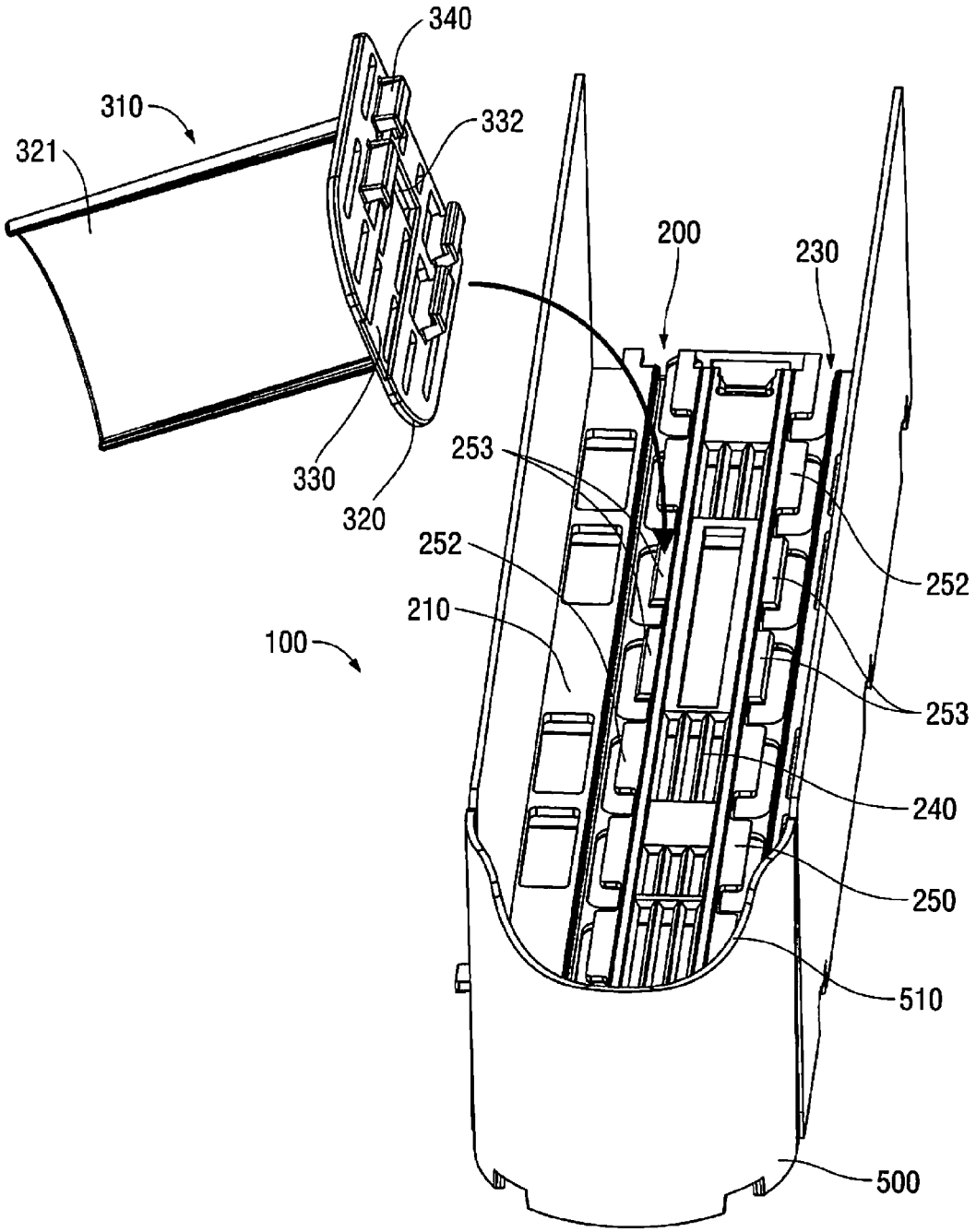
FIG. 5 is a perspective view of one guide assembly of the merchandising system showing a pusher assembly separated from the remainder of the guide assembly.
Figure 6:
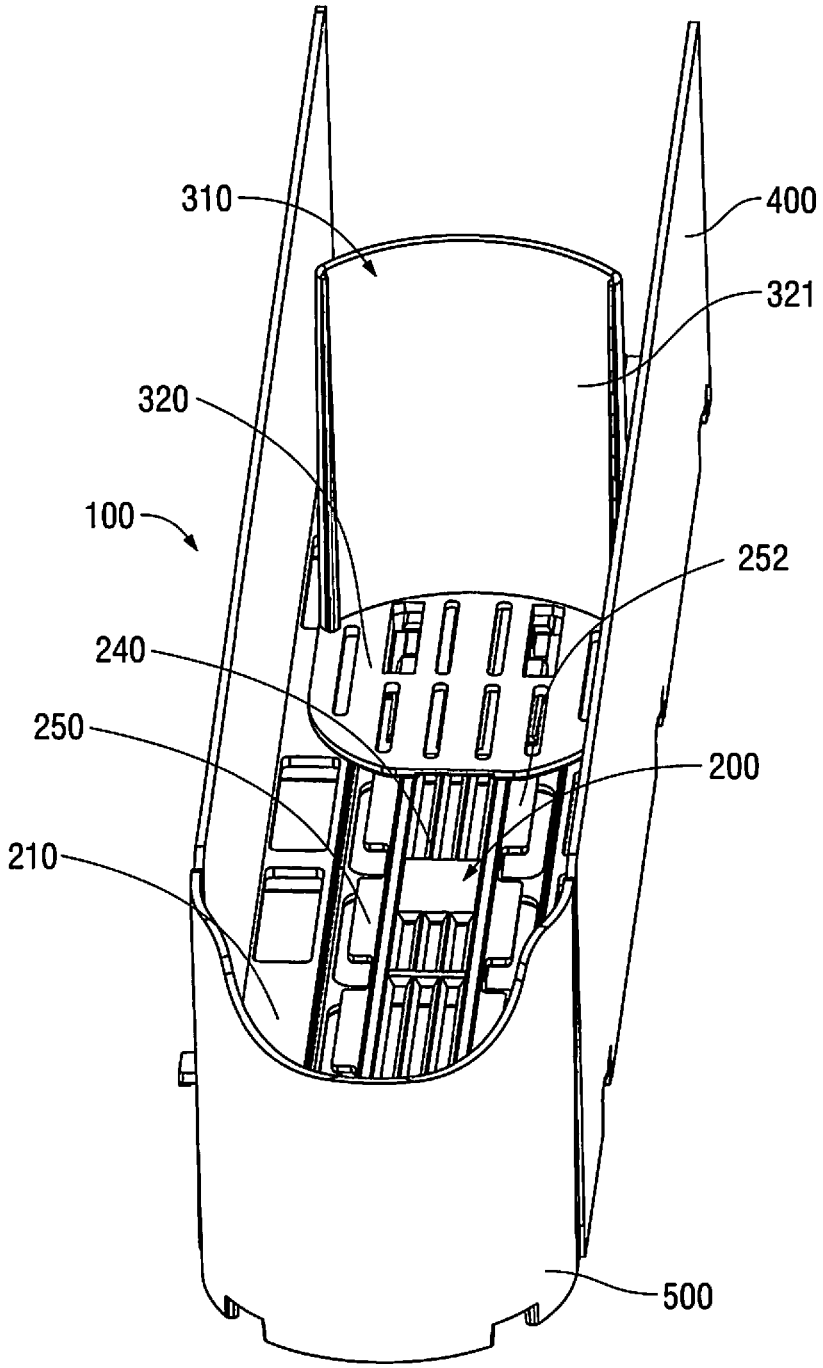
FIG. 6 is a perspective view of a portion of one guide assembly illustrating the pusher assembly in an intermediate position.
Figure 7:
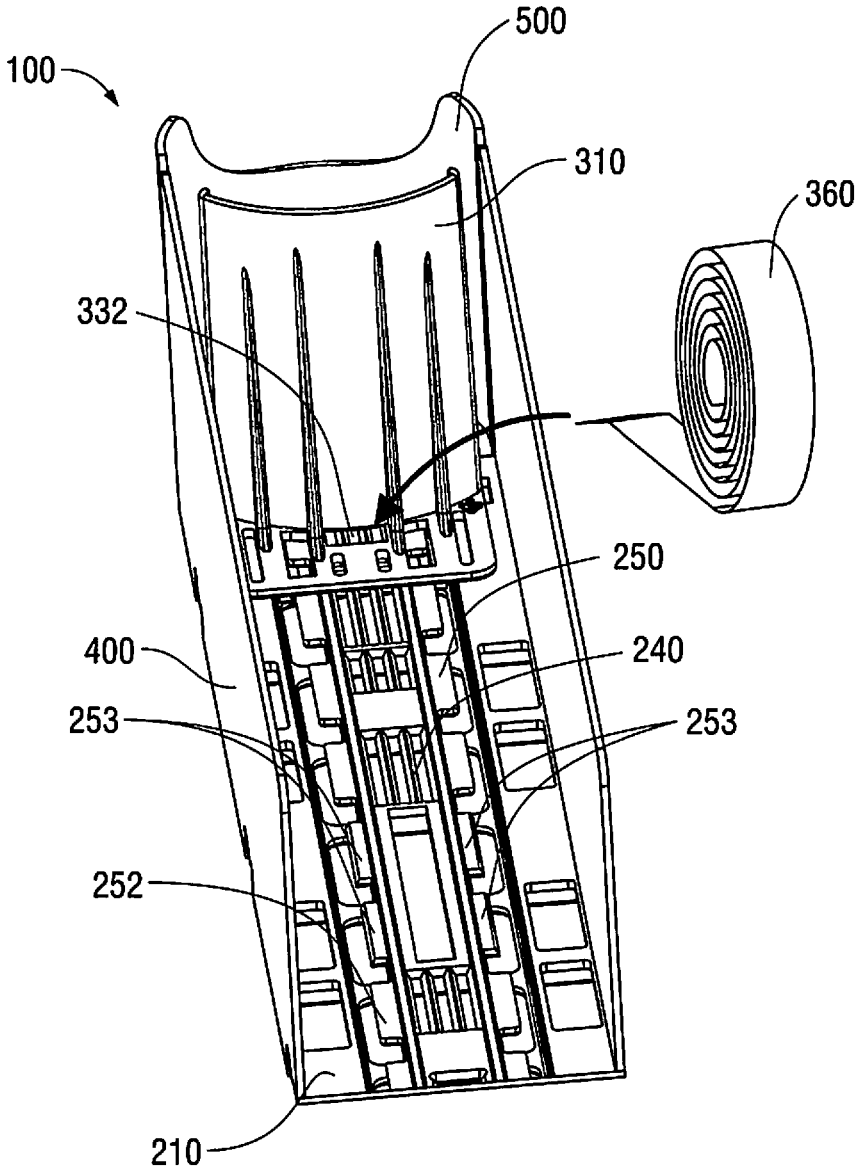
FIG. 7 is a perspective view, viewed from the rear, of the portion of the guide assembly of FIG. 6 showing a biasing member separated from the remainder of the guide assembly.

Referring now to FIGS. 3-13, the pusher assembly 300 includes a pusher member 310 and a biasing member 360 (e.g., a coiled spring). Pusher member 310 includes a horizontal member 320 and a substantially vertical member 321. In the illustrated embodiment, the vertical member 321 has an arcuate shape, which is configured to correspond to the contour of the product "P" (e.g., bottle) supported thereagainst. The horizontal member 320 includes an upper surface 322 (e.g., for supporting a product "P"), and a lower surface (or base-contacting surface) 324 that is configured to longitudinally slide along the product-supporting surface 210 of the base 200. The horizontal member 320 also includes a proximal portion 326, and a distal portion 328. The proximal portion 326 is configured to support a distal-most product "P" thereon, and the distal portion 328 supports at least a portion of the biasing member 360 thereon (FIG. 4). The horizontal member 320 also includes a track 330 (FIGS. 5 and 11) within its lower surface 324, and an opening 332 (FIGS. 5, 7 and 11) extending between the upper surface 322 and the lower surface 324. A portion of the biasing member 360 extends through the opening 332 and along the track 330.

Figure 11:
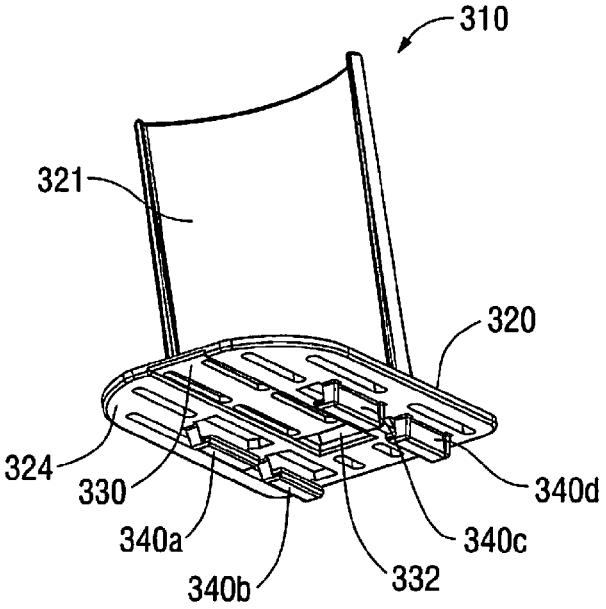
Figure 12:
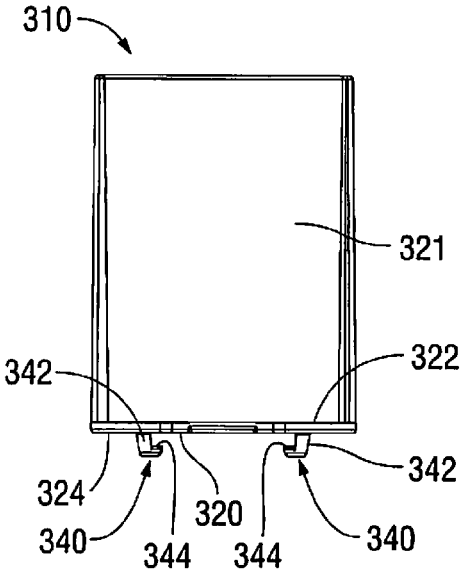
FIG. 12 is a front view of the pusher assembly of FIGS. 10 and 11.
Figure 13:
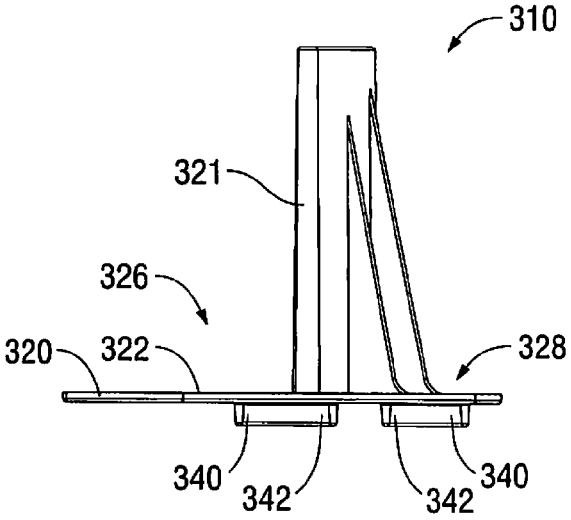
FIG. 13 is a side view of the pusher assembly of FIGS. 10-12.

The pusher member 310 also includes a plurality of legs 340 (FIGS. 5, 8A, 8B, 9 and 11-13) that extend below the lower surface 324 of the horizontal member 320. With particular reference to FIG. 11, the pusher assembly 300 includes a first leg 340*a*, a second leg 340*b*, a third leg 340*c* and a fourth leg 340*d*. In the illustrated embodiments, each leg 340 includes a vertical portion 342, and a horizontal portion 344 (FIG. 12) extending inwardly from the vertical portion 342, such that each leg 340 includes a substantially L-shaped cross-section. When the pusher assembly 300 is engaged with the base 200, the legs 340 of the pusher assembly 300 extend below the product-supporting surface 210 of the base 200 and mechanically engage the tabs 252 of the track 250, and are longitudinally slidable along the track 250. More particularly, and with particular reference to FIG. 9, when the pusher assembly 300 and the base 200 are mechanically engaged, the vertical portion 342 of each leg 340 abuts or is adjacent a lateral wall 254 of the tab 252, and the horizontal portion 344 of each leg 340 abuts or is adjacent a lower wall 256 of the tab 252.

This engagement between the legs 340 of the pusher member 310 and the track 250 of the base 200 helps ensure the pusher member 310 remains on the base 200 during use of the merchandising system 10. More particularly, when torque is applied to the merchandising system (e.g., during loading of the merchandising system 10 with products "P," when a consumer's shopping cart bumps into the merchandising system 10 or the shelf that the merchandising system 10 is positioned on, etc.) the engagement between the pusher member 310 (e.g., the legs 340) and the base 200 (e.g., the track 250) helps prevent the pusher member 310 from toppling over. For instance, when a downward force is applied to right side of the pusher member 310 (e.g., during torquing of the merchandising system 10), the legs 340*a* and 340*b* on the left side of the pusher member 310 are forced upward. There engagement between the horizontal portions 344 of these legs 340*a* and 340*b* and the lower wall 256 (FIG. 9) of a tab 252 of the track 250 helps prevent the pusher member 310 from becoming separated from the base 200 at that location. Additionally, the engagement between the legs 340 and the track 250 helps prevent the pusher member 310 from intentionally being separated from the base 200 (e.g., by vandals).

With particular reference to FIG. 4, to install the pusher member 310 onto the base 200, a user positions each leg 340 adjacent a shortened tab 253 (i.e., a discontinuity in the track 250), and moves the pusher member 310 proximally or distally such that the horizontal portion 344 of each leg is under a tab 252 or a shortened tab 253 of the track 250. It is envisioned that in lieu of, or in addition to shortened tabs 253, track 250 includes a space between adjacent tabs 252 that is large enough to accommodate the legs 340 of the pusher member 310. It is further envisioned that shortened tabs 253 (and/or the large space) are located at one or a plurality of locations between the proximal end 202 and the distal end 204 of the base 200 (e.g., not the proximal-most portion of the base 200 and not the distal-most portion of the base 200).

With reference to FIG. 3, the proximal member 500 of the merchandising system 10 is configured to attach to a proximal end of the base 200 via a snap-fit connection, for example. It is envisioned that at least a portion of the proximal member 500 is transparent or translucent to allow a consumer to view a portion of the proximal-most product "P1" on the merchandising system 10 therethrough. Additionally, in the illustrated embodiment, the proximal member 500 has an arcuate shape, which is configured to correspond to the contour of the product "P" (e.g., bottle) supported thereagainst. It is also envisioned that the proximal member 500 includes a scooped portion 510. The scooped portion 510 allows the proximal-most product "P1" to be better viewed by a consumer, allows the proximal-most product "P1" to be tipped down by a consumer to facilitate shopping of the products "P," and/or facilitates the loading of the products "P" onto the merchandising system 10, e.g., by a store employee.

Figure 8A:
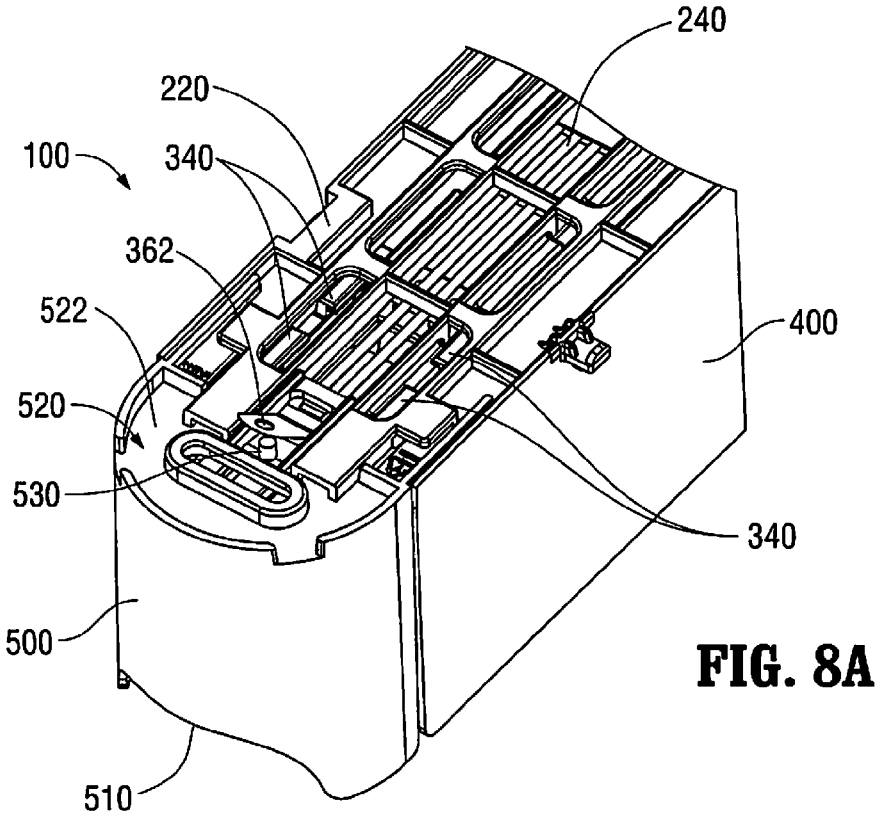
FIG. 8A is a perspective view, viewed from the bottom, of a portion of the guide assembly showing the biasing member separated from a proximal member.
Figure 8B:
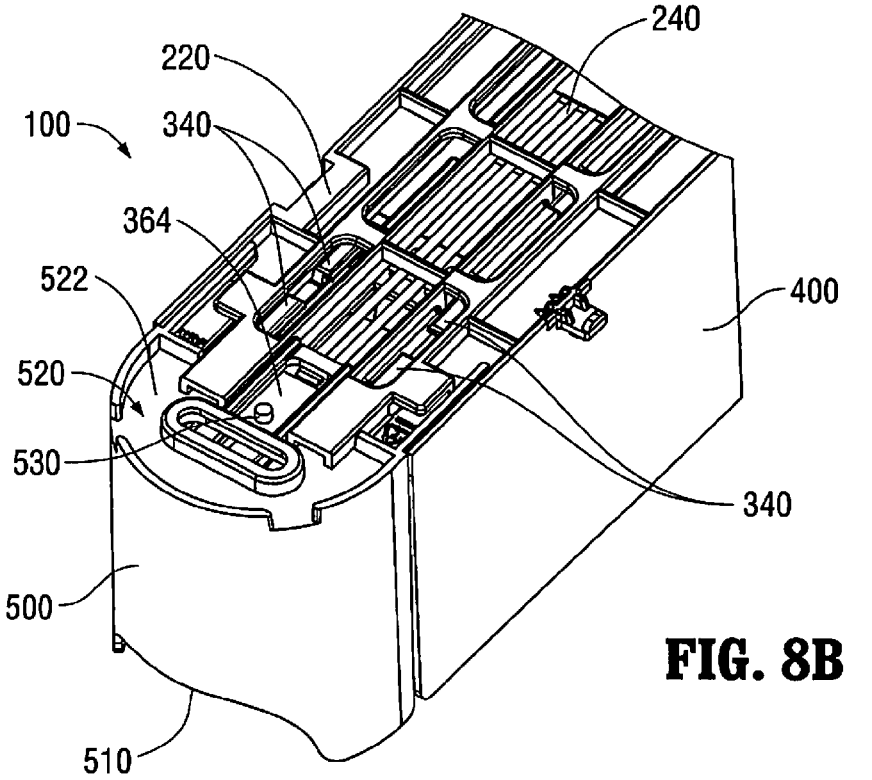
FIG. 8B is a perspective view, viewed from the bottom, of the portion of the guide assembly of FIG. 8A showing the biasing member engaged with the proximal member.
Figure 9:
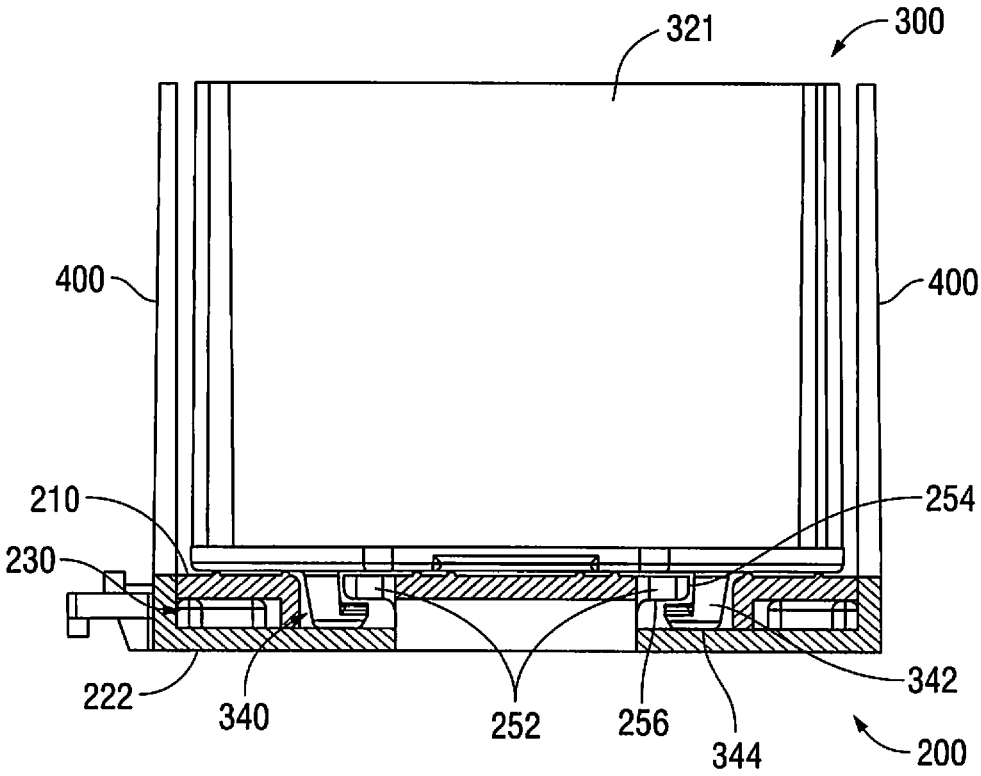
FIG. 9 is a cross-sectional view of the pusher assembly engaged with a base of the guide assembly.
Figure 10:
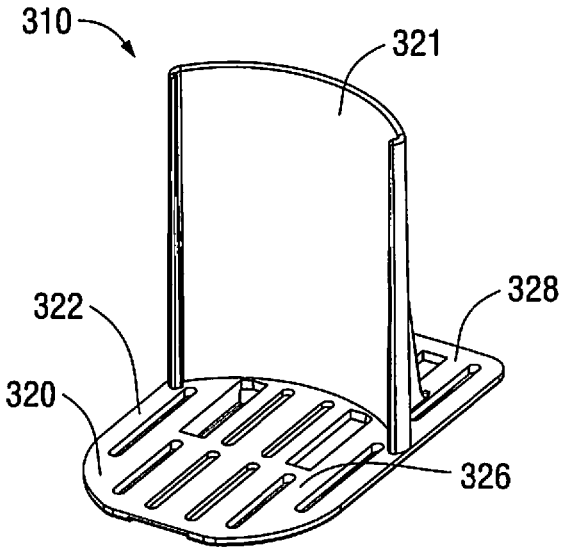
FIGS. 10 and 11 are perspective views of the pusher assembly of the present disclosure.

With particular reference to FIGS. 8A and 8B, a lower surface 522 of a base 520 of the proximal member 500 includes a pin 530 extending downwardly therefrom. The pin 530 is configured to mechanically engage a hole 362 disposed on a proximal portion 364 of the biasing member 360 (see also FIG. 3). Therefore, when the hole 362 is engaged with the pin 530 (FIG. 7B), the biasing member 360, and thus the pusher assembly 300, is mechanically coupled to the proximal member 500.

Additionally, the merchandising system 10 is configured to be used on shelves of various depths (i.e., the distance the shelf extends from the wall/support). Specifically, portions of the guide assemblies 100 are able to be broken-off or otherwise removed to effectively shorten the length of the guide assemblies 100. More particularly, and with reference to FIGS. 3, 4, 14A and 14B, the base 200 includes breakaway features 260, and the lateral guides 400 include breakaway features 410, that each allow for selective removal of portions of the base 200 and the lateral guides 400 to shorten the length of the guide assemblies 100.

Figure 14A:
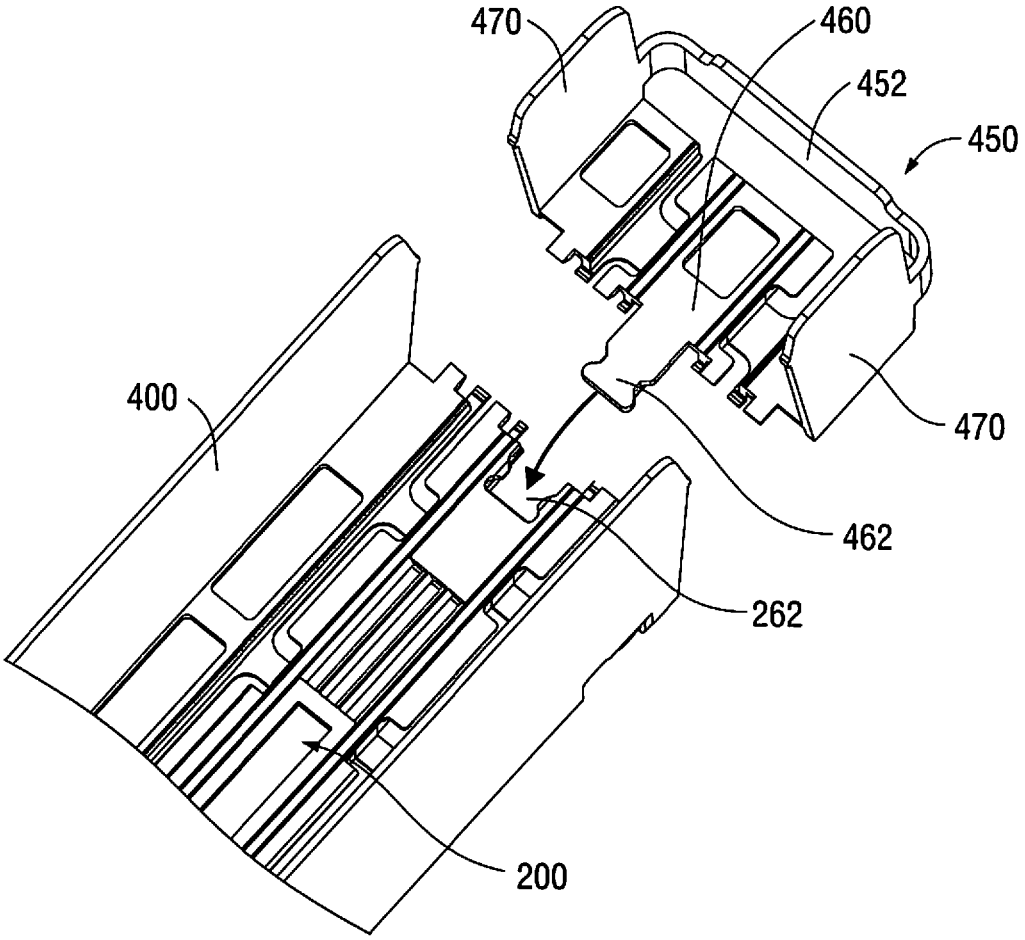
FIG. 14A is a perspective view of a portion of the guide assembly illustrating a distal portion separated from the remainder of the guide assembly.
Figure 14B:
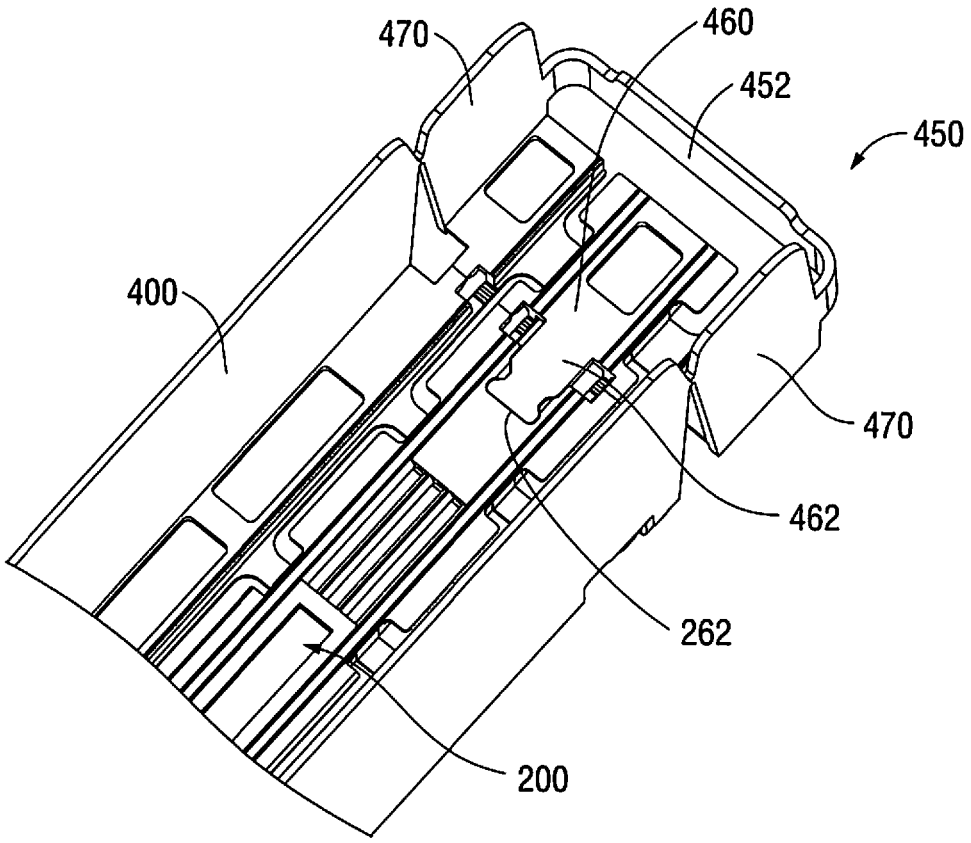
FIG. 14B is a perspective view of the portion of the guide assembly shown in FIG. 14A illustrating the distal portion engaged with the remainder of the guide assembly.

Referring now to FIGS. 14A and 14B, the distal section 450 includes the distal rail 452, a distal base 460, and distal lateral walls 470. The distal base 460 includes a proximally-extending finger 462 that is configured to engage and interlock with a corresponding cut-out 262 disposed at a distal end of the base 200. Accordingly, the distal section 450 is able to be removed (FIG. 14A), and re-installed (FIG. 14B) after one or more portions of the base 200 and lateral guides 400 have been removed.

Further, the pusher assembly 300 of the merchandising system 10 is still able to properly function across the breakaway features 260 and 410, the proximally-extending finger 462 and the cut-out 262, after some or all of the portions of the base 200 and the lateral guides 400 have been removed, and after the distal section 450 has been removed and re-installed.

The present disclosure also includes a method of displaying items using the merchandising system 10 described above, and a method of engaging the pusher assembly 300 with the base 200, as discussed above.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of the claims appended hereto.

The invention claimed is:

1. A merchandising system for a displaying a plurality of products, the merchandising system comprising:

a base including a product-supporting surface and a track disposed beneath the product-supporting surface, the base defining a longitudinal axis, the base including a proximal-most end, a distal-most end and a central section disposed between the proximal-most end and the distal-most end, the base including a lower surface and a gap, the gap defined between the lower surface and the product-supporting surface, the track including a plurality of spaced-apart tabs and entirely disposed within the gap, each tab of the plurality of spaced-apart tabs including a width that is perpendicular to the longitudinal axis; and a pusher member disposed in mechanical cooperation with the base and configured to slide longitudinally with respect to the base, the pusher member including a base-contacting surface and a plurality of legs downwardly depending from the base-contacting surface, wherein each leg of the plurality of legs is configured to mechanically engage the track;

wherein the track includes a discontinuity to enable the pusher member to be removed from the central section of the base, the discontinuity including at least one other tab having a width less than a width of an adjacent tab of the plurality of spaced-apart tabs.

2. The merchandising system of claim 1, wherein the discontinuity in the track is between the proximal-most end of the base and the distal-most end of the base.

3. The merchandising system of claim 2, wherein the track extends proximally of the discontinuity and wherein the track extends distally of the discontinuity.

4. The merchandising system of claim 1, wherein the plurality of legs includes a first leg disposed inwardly of a first lateral edge of the pusher member and a second leg disposed inwardly of a second lateral edge of the pusher member.

5. The merchandising system of claim 4, wherein each of the first leg and the second leg includes a vertical portion disposed in contact with the base-contacting surface of the pusher member and a horizontal portion, wherein an entirety of the vertical portion of the first leg is disposed inwardly of the first lateral edge of the pusher member, wherein an entirety of the vertical portion of the second leg is disposed inwardly of the second lateral edge of the pusher member, wherein the horizontal portion of the first leg extends from the vertical portion toward the second leg, and wherein the horizontal portion of the second leg extends from the vertical portion toward the first leg.

6. The merchandising system of claim 5, wherein each of the first leg and the second leg includes a substantially L-shaped cross-section.

7. The merchandising system of claim 1, wherein at least one leg of the plurality of legs includes a substantially L-shaped cross-section.

8. The merchandising system of claim 1, wherein a distal section of the base is configured to be removed to effectively shorten a length of the merchandising system.

9. The merchandising system of claim 8, further comprising a distal portion disposed distally of the distal section of the base, wherein the distal portion is selectively removable from the distal section of the base, and wherein the distal portion is re-installable with another section of the base after the distal section of the base has been removed.

10. The merchandising system of claim 9, wherein the distal portion includes a portion of the track.

11. The merchandising system of claim 10, wherein the pusher member is configured to slide along an entirety of the track both before the distal portion has been removed, and following removal of the distal section of the base and the re-installation of the distal portion.

12. The merchandising system of claim 9, wherein the distal portion includes a proximally-extending finger configured to mechanically engage a cut-out of the base.

13. The merchandising system of claim 1, wherein a plurality of distal sections of the base are configured to be individually removed to effectively shorten a length of the merchandising system, wherein the merchandising system further comprises a distal portion disposed distally of the distal section of the base, wherein the distal portion is selectively removable from a distal-most section of the base, and wherein the distal portion is re-installable with another section of the base after any number of the plurality of distal sections of the base have been removed.

14. The merchandising system of claim 1, further comprising a proximal member disposed adjacent the proximal-most end of the base, and further comprising a biasing member mechanically coupled to both the pusher member and the proximal member, the biasing member configured to proximally bias the pusher member.

* * * * *